United States Patent [19]

Youdelman

[11] 4,108,611

[45] Aug. 22, 1978

[54] PLASTIC FUEL, PRODUCTS MADE THEREFROM AND A NOVEL METHOD FOR STARTING AND PROMOTING FIRES USING THE FUEL

[76] Inventor: Myrna R. Youdelman, 7 Tennyson St., Hartsdale, N.Y. 10530

[21] Appl. No.: 359,907

[22] Filed: May 14, 1973

[51] Int. Cl.[2] ..... C10L 11/00; C06F 3/02

[52] U.S. Cl. ..... 44/38; 44/46

[58] Field of Search ..... 44/7.5, 35, 38, 46; 240/13; 431/288, 347

[56] References Cited

U.S. PATENT DOCUMENTS

| | | | |
|---|---|---|---|
| 42,658 | 5/1964 | Hinds | 240/13 X |
| 3,759,675 | 9/1973 | Lazarus et al. | 44/40 X |

*Primary Examiner*—Carl F. Dees

[57] ABSTRACT

This product provides a method for starting and promoting friendly fires utilizing a solid acrylic plastic as a "fire starter". This method is especially useful for initiating charcoal and wood fires for recreational purposes. This invention further provides a match wherein the body of the matchstick comprises a solid acrylic plastic. An additional aspect of this invention provides a light-generating device including a holder for solid fuel and a solid fuel comprising solid acrylic plastic. The preferred acrylic plastic is a cast bulk polymerized polymer.

3 Claims, No Drawings

PLASTIC FUEL, PRODUCTS MADE THEREFROM AND A NOVEL METHOD FOR STARTING AND PROMOTING FIRES USING THE FUEL

Wood, or wood derivatives, has been a major fuel for the initiation and promotion of "friendly" fires. For example, in a match, which until now, commonly comprised a body, a matchstick, made from wood or wood product, e.g. cardboard, plus a head which is ignitable by friction energy, the wood serves as a preliminary source of fuel; the ignited match is intended to be contacted with a primary source of fuel, in order to initiate combustion of such primary fuel. A significant use of wood products as fuel is in recreational fires. For example, in camp fires or grilling fires, useful for cooking, in which the primary fuel is usually charcoal. Various highly flammable materials have been used as "fire starters", for igniting the charcoal briquets, which are not readily ignitable directly from a match. The most common "fire starter" materials are the normally liquid hydrocarbons, generally derived from petroleum, which are readily ignitable and burn with an extremely hot flame suitable for promoting the ignition of a main combustible source, such as charcoal. The normally liquid hydrocarbons can be used in their liquid form, being applied as a liquid to the main combustion source; alternatively they can be provided in an apparently "solid" state, such as in a jelled form, which can be formed, for example, by admixing a major proportion of the normally liquid hydrocarbon fuel with a liquid synthetic resin, such as a urea-formaldehyde resin syrup (U.S. Pat. No. 3,615,286), or with a normally solid plastic resin, as in U.S. Pat. No. 3,231,346. Other fuels containing a synthetic plastic include, for example, polypropylene admixed with heavy hydrocarbon fuels, such as asphalt, or coal dust in admixture with a phenol-formaldehyde resin, see U.S. Pat. Nos. 2,567,136 and 3,036,900.

However, the "fire starter" which is most commonly used by the consuming public for starting charcoal fires in the well known backyard charcoal barbecue are the normally liquid hydrocarbons in their liquid state. The liquid is applied so as to wet the charcoal briquets, which are then ignited. The initial flame is fueled by the hydrocarbon fuel absorbed by the briquets. The temperature of the briquets is eventually raised sufficiently to ignite the charcoal, i.e. the primary combustion fuel.

A problem presented by the common liquid hydrocarbon fire starters, is the production of undesirable and unpleasant smoke and fumes which, in sufficient concentration, not only affects the health ahd safety of individuals adjacent to the combusting material, but also can adversely affect the smell and taste of any food being cooked over the briquets. There is, of course, also a safety hazard with the use of the liquid hydrocarbon fuels, which are almost explosively combustible, readily ignited materials.

A further problem with the various jelled or mixed hydrocarbon-synthetic polymer solids is the cost of forming these composite materials.

It has of course been known, since such materials were initially formed, that the various synthetic polymeric resins, especially those based upon a backbone, or chain, of carbon atoms, with or without pendant, or side, groups, are combustible. Indeed, as pointed out above, certain of them have been used in admixture with other fuels for the production of various solid fuels.

It has now been discovered that one particular type of polymer is surprisingly effective and safe for use as a "fire starter" as well as being extremely useful for a variety of purposes where a slow, steady combustion, without loss of structural integrity until the entire unit is consumed, is advantageous, such as for matchsticks and safety lights.

In accordance with the process of the present invention, a friendly fire can be initiated and promoted by placing solid, acrylic plastic, of suitable size and shape, in contact with a primary combustion fuel and igniting the acrylic plastic, whereby the acrylic plastic burns for a period sufficient to ignite the primary combustion fuel and to promote a friendly fire thereby.

The term "friendly fire" is intended to represent a fire which is intentionally ignited, which is restrained to within certain limited boundaries and which is utilized for a specific purpose, e.g. for cooking, heating, lighting, or even mere decoration.

Further, in accordance with this invention, there is provided a match comprising a matchstick formed of solid acrylic plastic and a match head formed of a material ignitable by friction. Further, in accordance with this invention, there is provided means for generating light, comprising a solid fuel holder and a solid fuel comprising solid acrylic plastic of a suitable size and shape to fit within and to be held by the fuel holder and to generate light when ignited.

The "acrylic plastic" useful in accordance with the present invention is a polymer of an ester of acrylic acid or of an ester of an alkacrylic acid, especially methacrylic acid, or of acrylic acid or of an alkacrylic acid. Most preferably, the acrylic plastic is primarily a polymer of one or more lower alkyl esters of an alkacrylic acid, especially of methacrylic acid. Other preferred polymers include the polymers of one or more lower alkyl acrylic esters, of acrylic acid or of methacrylic acid.

It should be pointed out, that in practice it is doubtful whether polymeric acrylic plastics would be manufactured exclusively or even primarily for the purpose of the present invention. As a practical matter, acrylic plastics which are used for other purposes, and which are available on the market in commercial quantities would be utilized for the present invention. Such commercial acrylic plastics generally include various other additives, or combinations of polymers, which improve the properties of the acrylic plastics for the other major uses to which these plastics are to be put but which are not relevant to the present invention. Additives commonly used for acrylic plastics and which, at least in small quantities, do not generally interfere with the present invention, include plasticizers, such as alkyl phthalate esters, lubricants, such as stearic acid, and various pigments and dyes. Similarly other polymers, copolymers, or small proportions of comonomers are often present in the preferred acrylic plastics.

For example, a preferred polymer of an alkyl ester of an alkacrylic acid, e.g. poly (methyl methacrylate), can contain a minor proportion of a methacrylic acid polymer and/or of an alkyl acrylate polymer, either as a homopolymer or as a copolymer with the alkacrylic ester. The presence of such other materials, whether additives or other polymers, which do not substantially deleteriously interfere with the properties of the acrylic plastic for the purposes of this invention, is included within the scope of this invention. Other materials which do have a substantial deleterious effect, such as generating excessive smoke, fumes or an unpleasant odor while burning, or which have a dangerous or unpleasant residue, should not be present.

It has been found that the most preferred acrylic plastic materials are those which are cast directly during polymerization, i.e. by bulk polymerization. Bulk polymerization is the usual commercial method of preparing cast, usually clear, acrylic sheets, especially from a polymer which is derived from methyl methacrylate, alone or in admixture with a small proportion of alkyl acrylic esters or other alkyl methacrylic esters, such as ethyl acrylate, propyl acrylate, butyl acrylate, ethyl methacrylate, propyl methacrylate and butyl methacrylate. These most preferred bulk polymers are generally formed as a solid, clear or translucent sheet, which, in the absence of pigments or dyes, is transparent and colorless, i.e. substantially water-white. Commercially available materials often contain pigments or dyes, as well as the other additives set out above, in extremely small proportions which normally do not interfere with the desired burning properties of the polymer.

Such preferred bulk polymerized, cast materials are formed from a liquid reaction mixture comprising monomer or low molecular weight liquid polymer alone or in admixture with monomer, known as "syrup"; the preferred primary monomer is methyl methacrylate. Often, small amounts, generally less than five or ten percent by weight, of one or more modifying monomers, is present, such as methacrylic acid, or acrylic acid, and lower esters thereof, e.g. an alkyl acrylate. Other additives are often mixed into the polymerizable liquid such as a lubricant, e.g. stearic acid, and/or a plasticizer, e.g. butyl phthalate, and a pigment or dye. Such additives and modifying monomers, as pointed out above, are substantially irrelevant to the properties required for the present invention. The polymerizable liquid is polymerized when a catalyst is present, such as an organic peroxide or a free radical catalyst.

A bulk polymerized preferred acrylic plastic, for example a poly (methyl methacrylate), can have a Vicat softening temperature of about 120° C and a glass temperature of about 105° C.

Examples of useful polymers include the homopolymers, poly-(methyl methacrylate, poly(ethyl methacrylate), poly(n-butyl methacrylate), poly(t-butyl methacrylate), poly(methyl acrylate), poly(ethyl acrylate), poly(n-butyl acrylate), and poly(t-butyl acrylate). Commercially available copolymers include copolymers of methyl methacrylate and methacrylic acid, methyl methacrylate and butyl acrylate, methyl methacrylate and ethyl acrylate, methyl methacrylate and methyl acrylate, methyl methacrylate and butyl methacrylate; commercially available terpolymers, include for example, terpolymers of methyl methacrylate, butyl acrylate, and methacrylic acid. Mixtures of homopolymers, e.g. poly(methyl methacrylate), and copolymers, such as the copolymer of butyl acrylate and methyacrylic acid, would also be useful in accordance with the process of the present invention.

Generally the bulk polymerized polymers which have been found to be most useful in the process and the products of the present invention, are formed as cast sheets, or bars.

Cast, bulk polymerized, acrylic plastic sheets, having a sufficiently large surface area to be used for forming a large number of individual pieces for use in accordance with the process of the present invention, are presently available in thicknesses of from about 0.03 in. to about 4.25 ins. Such sheets can be readily cut into strips or other shapes of any desired size. Significantly larger and thinner sheets can be obtained for special purposes if desired.

Preferably, acrylic plastic sheets having a thickness in the range of from about 1/16 in. to about ¾ in. are extremely useful in forming fire starter strips in accordance with the present invention.

Matchsticks and light generating fuels are generally formed in the shape of bars, having either polygonal or curvilinear cross-section (or even annular cross-sections), which have a minimum thickness of about 1/16 in. Such bars could also be used in place of, or in combination with, strips as a fire starter. Matchsticks are preferably formed having a thickness of from about 1/16 in. to about 5/32 in., and bars to serve as light-generating fuels, can be formed having a thickness of from about ⅛ in. to about 1 in. Preferably, such bars are substantially square, or other substantially equilateral polygon, or circles. Other shapes can be used if desired, e.g. rectangles and ellipses, in cross-section.

The properties of the solid acrylic plastic for use in the process and products of the present invention have the following advantages:

1. The acrylic plastics burn slowly and steadily until completely consumed. For example, a strip comprising primarily cast poly(methyl methacrylate), (¾ in. × ⅛ in. × 4 in.) burns for about 10 minutes. Thus, when used as a fire starter, the acrylic plastic does not tend to burn out too quickly, as is the case with wooden kindling.

2. The acrylic plastics do not conduct heat readily. Thus, an individual need not be afraid of being burned when holding one end of a burning strip.

3. During combustion of the acrylic plastic, no unpleasant odor is observed, and very little smoke was generated. Further, substantially no residue remains with the preferred acrylic plastics, which are practically entirely consumed.

4. Unique to the acrylic plastics of the present invention is the fact that during ignition they emit a "sizzling" sound; this provides extremely helpful as a warning that the acrylic plastic material is burning, even when the flame is not visible, as in bright sunlight.

5. The solid acrylic resin is nonporous and does not absorb moisture. Thus its combustion, or ignition, characteristics are not affected, even when stored out of doors and uncovered for long periods.

6. The solid acrylic plastic materials useful for the present invention can be formed, as by casting, or cutting a larger casting, into practically any size or shape desired for use in accordance with the present invention.

When utilizing the acrylic plastic in the fire starting process of the present invention, it is desirable that the acrylic plastic be individual pieces in the form of strips or bars of relatively short length and thickness. The size shall be such that the piece can be readily handled and easily placed into, for example, a pile of charcoal briquets in a backyard barbecue grill. Thus, the individual fire starter pieces should be sufficiently large so as to be easily handled and to be safely carried even if one end has been ignited prior to placing the material into contact with the primary fuel, e.g. a pile of charcoal briquets. Thus it is believed that the piece should be at least about 2 in. long and preferably at least about 3in. long, at least about ¼ in. and preferably at least about ½ in. wide, and at least about 1/16 in. thick. It is preferred that the thickness and width of the strip be sufficient that the strip be substantially rigid so as not to bend even when one end is ignited, thus providing greater safety for the user.

It is pointed out, that in carrying out the fire starting process in accordance with the present invention, the acrylic plastic can be placed in contact with the primary fuel supply for the friendly fire, e.g. charcoal briquets, and then ignited or, alternatively, a portion, generally one end, of the acrylic plastic can be ignited and then placed in contact with the primary fuel. Such a procedure would be especially valuable when the acrylic plastic includes a self-igniting portion, such as on a match, which would be directly ignited by friction and then placed in contact with the primary fuel source. Generally, of course, it is understood that one or more pieces of the acrylic plastic can be utilized to ignite a primary fuel supply. For example, in a pile of charcoal briquets, depending on its size and the time allowed for preparation, one or several individual bars or strips of the acrylic plastic can be inserted at strategic locations throughout the pile.

When employing the acrylic plastic of the present invention as a fire starter, it can be applied to a particular primary fuel in numerous ways. For instance, if the primary fuel is charcoal, strips of the acrylic plastic can be inserted between the individual pieces of the charcoal, or, if preferred, directly underneath a pile of the fuel. As is readily apparent, the manner of applying the acrylic plastic material of the present invention to a primary fuel and the exact juxtaposition of the primary fuel and acrylic plastic can vary depending upon the nature and configuration of the primary fuel as well as the individual's preference.

Because of the slow but steady rate of burning and the bright light which is generated by the burning acrylic plastic pieces, a useful light source can be formed utilizing solid acrylic plastic as the fuel source. Such light source can be utilized for example, as an emergency light means, as a warning flare on highways, and in the event of an accident occurring, for example, to campers in desolate areas, or even for decorative or functional lanterns for generating light out of doors, e.g. in the family's backyard.

The product of this invention thus provides a light source, such as a flare or lantern, comprising a holder and fuel within the holder, the fuel comprising a solid acrylic plastic. Preferably, the holder comprises, in addition, transparent shield means designed and adapted for protecting the ignited acrylic plastic from wind and rain. Such a source of fuel can include a single, preferably rod-shaped element, or a multiplicity of such elements, i.e. two or more. For example, a lantern body providing transparent shielding surrounding the fuel holder can comprise one large diameter rod of acrylic plastic or two or more smaller diameter rods. For indoor use, or for use where wind is not a problem, a rod of acrylic plastic can be held, for example, in an open holder, such as a candlestick holder. When used as an emergency warning flare, for example, the holder can comprise means for maintaining the device upright on the ground including, for example, means for anchoring the device in the ground by being inserted into the ground, e.g. as a spike.

The following examples illustrate preferred embodiments of the present invention. They are to be taken as exemplary and not exclusive of the scope of the present invention.

EXAMPLE I

In a double hibachi stove, i.e. a double grill comprising two immediately adjacent grilling units, a pile of 20 charcoal briquets approximately 1½ ins. square, were placed in each grill. In the middle of the first pile, was inserted a strip of a acrylic plastic material ⅛ ins. × 4 ins. × ⅞ ins. comprising primarily a poly (methyl methacrylate) homopolymer. The strip was cut from a cast, bulk polymerized, sheet of acrylic plastic, which was sold under the trademark Acrylite GP, by the American Cyanamid Company (see the Physical Properties Bulletin No. 454, published by that company). The strip was placed on its ⅛ in. thick edge, such that the 1 in. dimension was vertical, and inserted into the center of the pile of briquets, with about 178 in. protruding from the pile. The protruding end was ignited with a match and began to burn slowly but steadily, generating a pleasant sizzling sound as it burned. The acrylic strip was completely consumed within about 10 minutes. By that time an intense flame had been generated at the core of the pile of 20 briquets. After approximately another 20 minutes all the briquets had become white, indicating they all had been ignited, and the fire was ready to grill food.

In order to compare the effectiveness of the conventional liquid fire starters, a liquid petroleum hydrocarbon fire starter, sold under the trademark "Boron" charcoal lighter, was applied to the second pile of charcoal briquets by squirting the liquid from the can and wetting the charcoal briquets thoroughly. After waiting about 3 minutes to permit the liquid to penetrate the charcoal, in accordance with the instructions set forth on the can, the briquets were ignited. Upon ignition, a large flame erupted, reaching about 10 ins. to 12 ins. into the air and emitting a heavy odoriferous black smoke. The intense flame continued for about 3 minutes, after which time the flame subsided, but portions of many of the 20 briquets had been ignited. After about another 25 minutes, the ignition had spread and all of the briquets had burned to the same degree of whiteness as was found with the first batch, and the fire was ready to grill food.

Accordingly, as shown from above, the acrylic plastic fire starter, in accordance with the present invention, required approximately the same amount of time to ignite and to promote the briquet charcoal fire to the desired degree but without the danger entailed in utilizing a volatile liquid fuel and without the odor and smoke involved with such hydrocarbon fuel. It is pointed out that the can of Boron charcoal lighter contained a "danger" warning, which is required by statute for such flammable liquids. The acrylic plastic on the other hand, used in accordance with the present invention, does not require such a warning and is indeed, not dangerous.

EXAMPLE 2

Strips of the acrylic plastic fire starter in accordance with the present invention were tested in comparison with equal size strips of other plastic to compare their effectiveness.

| EX. | MATERIAL USED | RESULT |
|---|---|---|
| 2A | polyethylene | Burned vey quickly within |

-continued

| EX. | MATERIAL USED | RESULT |
|---|---|---|
| | | a minute or two. |
| 2B | polystyrene | Emitted a dark, black smoke and a very strong unpleasant odor while burning. |
| 2C | cast acrylic plastic | Burns slowly and steadily substantially without any odor or smoke until completely consumed, in about 10 min. |

The strips tested in all cases were each $\frac{7}{8}$ inch × 4 inch × $\frac{1}{8}$ inch. The cast acrylic used was the same as that described above for Example I.

What is claimed is:

1. A method for initiating and promoting a friendly fire, which comprises directly contacting a primary source of combustible fuels with a piece of cast, bulk polymerized solid acrylic plastic polymer of a monomer selected from the group consisting of lower alkyl esters of alkacrylic acids and lower alkyl esters of acrylic acid, the acrylic plastic being of a size and shape designed and adapted to be readily contacted with the primary source of fuel and igniting the acrylic plastic, whereby the acrylic plastic burns to an extent sufficient to ignite said primary combustible fuel and promote a friendly fire therewith and wherein the piece of acrylic plastic has a minimum major dimension of about 2 inches.

2. A match comprising a matchstick, which in turn is comprised of an elongated piece of a solid acrylic plastic polymer of a monomer selected from the group consisting of lower alkyl esters of alkacrylic acids and lower alkyl esters of acrylic acid, and a match head, formed at one end of the matchstick, comprising a material which is ignitable by friction.

3. The match of claim 2, wherein the match head comprises phosphorus and sulphur.

* * * * *